United States Patent [19]

Yoshikawa et al.

[11] Patent Number: 4,863,038

[45] Date of Patent: Sep. 5, 1989

[54] BILL RECEIVING AND DISPENSING MACHINE

[75] Inventors: Eiichi Yoshikawa, Hasuda; Eisaku Sano, Tokyo, both of Japan

[73] Assignee: Laurel Bank Machines Co., LTD., Tokyo, Japan

[21] Appl. No.: 110,366

[22] Filed: Oct. 20, 1987

[30] Foreign Application Priority Data

Oct. 30, 1986 [JP] Japan ..... 61-258956

[51] Int. Cl.[4] ..... B07C 5/00

[52] U.S. Cl. ..... 209/534; 271/3.1; 271/187; 271/315

[58] Field of Search ..... 209/534; 271/3.1, 4, 271/6, 7, 9, 315, 187, 207; 232/15

[56] References Cited

U.S. PATENT DOCUMENTS

| | | | |
|---|---|---|---|
| 3,083,896 | 4/1963 | Cairelli et al. | 232/15 |
| 4,431,178 | 2/1984 | Kokubo et al. | 271/315 X |
| 4,434,359 | 2/1984 | Watanabe | 271/9 X |
| 4,549,661 | 10/1985 | Morishita et al. | 209/534 |
| 4,552,351 | 11/1985 | Tsukamoto | 271/315 X |
| 4,681,229 | 7/1987 | Uesaka et al. | 271/3.1 X |
| 4,726,474 | 2/1988 | Arikawa et al. | 209/534 |

FOREIGN PATENT DOCUMENTS

| | | |
|---|---|---|
| 3736263 | 5/1988 | Fed. Rep. of Germany . |
| 58-39392 | 3/1983 | Japan . |
| 60-59492 | 4/1985 | Japan . |
| 60-67334 | 4/1985 | Japan . |
| 60-78332 | 5/1985 | Japan . |
| 60-100283 | 6/1985 | Japan . |
| 60-251487 | 12/1985 | Japan . |
| 61-18087 | 1/1986 | Japan . |

*Primary Examiner*—Joseph J. Rolla
*Assistant Examiner*—David H. Bollinger
*Attorney, Agent, or Firm*—Fleit, Jacobson, Cohn, Price, Holman & Stern

[57] ABSTRACT

A bill receiving and dispensing machine in which a bill containing mechanism is mounted on the back of a front door of the machine body for improving handling of bills contained within the machine body. The bill receiving and dispensing machine enables easy exposure of the bill containing components merely by opening a front door for carrying out inspection, additional charging of bills, and maintenance of the main components of the machine. According to the bill receiving and dispensing machine of the present invention, the received bills are transferred to the discriminating route and a part of the bills discriminated as "genuine" are held in the circulating-bill pooling section as bills for dispensation and the other genuine bills are transferred above the received-bill box mounted on the front door and then directly dropped into the box through the top opening thereof. Since the bill containing apparatus or the received-bill box can be opened simultaneously with the opening of the front door, the front inside of the machine body behind the bill containing apparatus is exposed merely by opening the front door. This makes it easy to inspect the circulating-bill pooling section and to charge additional bills.

1 Claim, 4 Drawing Sheets

BILL RECEIVING AND DISPENSING MACHINE

BACKGROUND OF THE INVENTION

The present invention relates to a bill receiving and dispensing machine for reusing part of the received bills as bills for dispensation, and more particularly to a bill receiving and dispensing machine in which a bill containing mechanism is mounted on the back of a front door of the machine body for improving the handling of bills contained within the machine body.

There has been used a so-called "circulation type" bill receiving and dispensing machine in which part of the received bills are reused as bills for dispensation in order to improve the efficiency of the bill receiving and dispensing operation.

For example, such a circulation type bill receiving and dispensing machine is disclosed in Japanese laid-open patent publication No. 039392/1983. The prior art bill receiving and dispensing machine is adapted to reuse at least a part of the received bills as bills for dispensation, with the received bills being discriminated by passing them through a discriminating section or route. This bill receiving and dispensing machine includes a plurality of boxes for containing received bills or dispensation bills which can be horizontally pulled out for enabling easy handling of the bills and easy maintenance of the machine.

However, in the bill receiving and dispensing machine having drawer type bill containing boxes of the prior art, it is very difficult to use and service the boxes or main components positioned deep in the machine body and the machine requires a large front space for such use and maintenance.

SUMMARY OF THE INVENTION

It is an object of the present invention to provide a novel bill receiving and dispensing machine in which the bill containing components can be easily exposed merely by opening a front door for carrying out inspection, additional charging of bills and maintenance of the main components of the machine.

According to the present invention, there is provided a bill receiving and dispensing machine adapted to feed out received bills into a bill discriminating route and having a circulating-bill pooling section for holding a part of the bills discriminated as genuine or normal as bills for dispensation, characterized in that the bill receiving and dispensing machine comprises a front door for exposing the inside of the machine body, and a received-bill box mounted on the back of the front door for receiving and holding the received bills dropped from a received-bill route through a top opening of the box.

Also according to the present invention, there is provided a bill receiving and dispensing machine adapted to feed out received bills into a bill discriminating route and having a circulating-bill pooling section for holding a part of the bills discriminated as genuine or normal as bills for dispensation, characterized in that the bill receiving and dispensing machine comprises a front door for exposing the inside of the machine, an accumulation wheel having a plurality of vanes and mounted on the back o the front door and positioned at the fore-end of a transferring route of a received-bill route for rotating bills fed out from the transferring route with the bills held between the vanes and for scraping the bills away therefrom and accumulating the bills, and a received-bill box also mounted on the back of the front door for receiving and holding the accumulated bills through a top opening of the box.

Further according to the present invention, there is provided a bill receiving and dispensing machine adapted to feed out received bills into a bill discriminating route and having a circulating-bill pooling section for holding a part of the bills discriminated as genuine or normal as bills for dispensation, characterized in that the bill receiving and dispensing machine comprises a front door for exposing the inside of the machine body and a bill containing apparatus mounted on the back of the front door for receiving and holding the received bills dropped from a received-bill route through a top opening of the bill containing apparatus, and that said circulating-bill pooling section is arranged behind the bill containing apparatus.

In one embodiment of the bill receiving and dispensing machine of the present invention, the received bills are transferred to the discriminating route and the genuineness is discriminated. A part of the bills discriminated as "genuine" are held in the circulating-bill pooling section as bills for dispensation and the other genuine bills are transferred above the received-bill box mounted on the front door and then dropped into the box through the top opening thereof.

In another embodiment, the bill receiving and dispensing machine is provided with an accumulation wheel between the received-bill route and the received-bill box for rotating bills fed out from the received-bill route with the bills held between the vanes thereof and for scraping the bills away therefrom and dropping the bills into the received-bill box through the top opening thereof.

Since the bill containing apparatus can be opened simultaneously with the opening of the front door, the front inside of the machine body behind the bill containing apparatus is exposed merely by opening the front door. This makes it easy to inspect the circulating-bill pooling section and to charge additional bills.

BRIEF DESCRIPTION OF THE DRAWINGS

Other objects and advantages of the present invention will become apparent from the following detailed description of preferred embodiments of the present invention taken in reference to the accompanying drawings in which.

Figure 4:
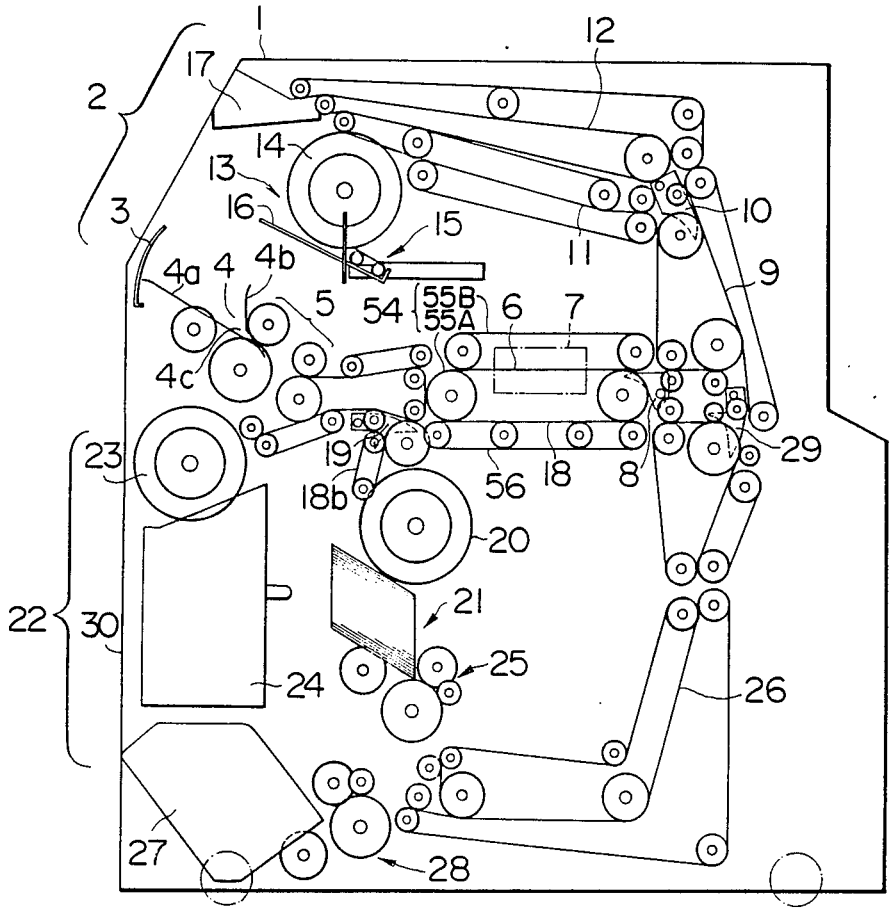

Firstly, the general arrangement of the bill receiving and dispensing machine will be described referring to FIG. 4. Similar to earlier cases, which see the bill receiving and dispensing machine shown in this preferred embodiment is intended that it circulates and reuses only 10,000 yen bills as bills for dispensation in all denominations of the received bills such as 1,000 yen, 5,000 yen and 10,000 yen bills.

When an order of bill reception is made by the user, a shutter 3 of a dealing port 2 mounted on a machine body 1 is opened to expose a bill receiving and dispensing port 4. When bills (or bill) are actually entered into the dealing port 2, the received bills are transferred by a received-bill feeding-out apparatus 5 to a discriminating section 7 through a discriminating route 6. The discriminated bills are guided into a common route 9 by a first fork 8. Bills discriminated as genuine at the discriminating section 7 are guided by a second fork 10 into an accumulating route 11. On the contrary, bills discriminated as counterfeit are guided into a rejecting route 12. The genuine bills on the accumulating route 11 are continuously fed via a temporary pooling and accumulating wheel 14 of a bill delivering apparatus 13 to a bill supporting plate 16 forming a part of a bill accumulating and transferring mechanism 15, and the counterfeit bills on the rejecting route 12 are fed into a rejecting port 17.

The bills accumulated on the bill supporting plate 16 are transferred to a position above the bill receiving and dispensing port 4 and dropped thereon. The bills dropped onto the port 4 are then transferred to the discriminating route 6 through the received-bill feeding-out apparatus 5 with them pressed down by a bill pressing-down apparatus (not shown). The bills discriminated as 10,000 yen bills at discriminating section 7 are guided into a bill receiving route 18 by the first fork 8 and then fed into a circulating-bill pooling section 21 by a third fork 19 via a circulating-bill accumulating wheel 20. On the contrary, bills other than 10,000 yen bills are guided into a received-bill containing apparatus 22 by the third fork 19 and then contained in a received-bill box 24 via an accumulating wheel 23 for containing received bills.

When an order of bill dispensation is made by the user, the 10,000 yen bills are fed out to a bill dispensing route 26 from the circulating-bill pooling section 21 by a circulating-bill feeding-out apparatus 25. The bills other than 10,000 yen bills, for example, 1,000 yen bills or 5,000 yen bills are prepared beforehand a dispensation bill containing apparatus (dispensation bill box) 27 and fed out by a dispensation bill feeding-out apparatus 28 to the bill dispensing route 26. During these operations, abnormalities, for example, whether the bills for dispensation are fed in double overlapped condition, is checked. When some abnormality is found, such bills are returned to the received-bill box 24 of the received-bill containing apparatus 22 by a fourth fork 29, the received-bill route 18 and the third fork 19. On the contrary, when no abnormality is found, the bills are guided to the common route 9 by the fourth fork 29 and then guided by the second fork 10 to the accumulating route 11. The bills on the accumulating route 11 are then continuously accumulated on the bill supporting plate 16 of the accumulating and transferring mechanism 15 by the bill temporary pooling and accumulating wheel 14. After having accumulated thereon to a desired amount of money, the bills on the bill supporting plate 16 are dropped onto the bill receiving and dispensing port 4 by driving the accumulating and transferring mechanism 15. Finally, by opening the shutter 3, it permits the user to take out the bills from the port 4.

Details of the bill receiving and dispensing machine of the present invention will be hereinafter described.

Figure 1:
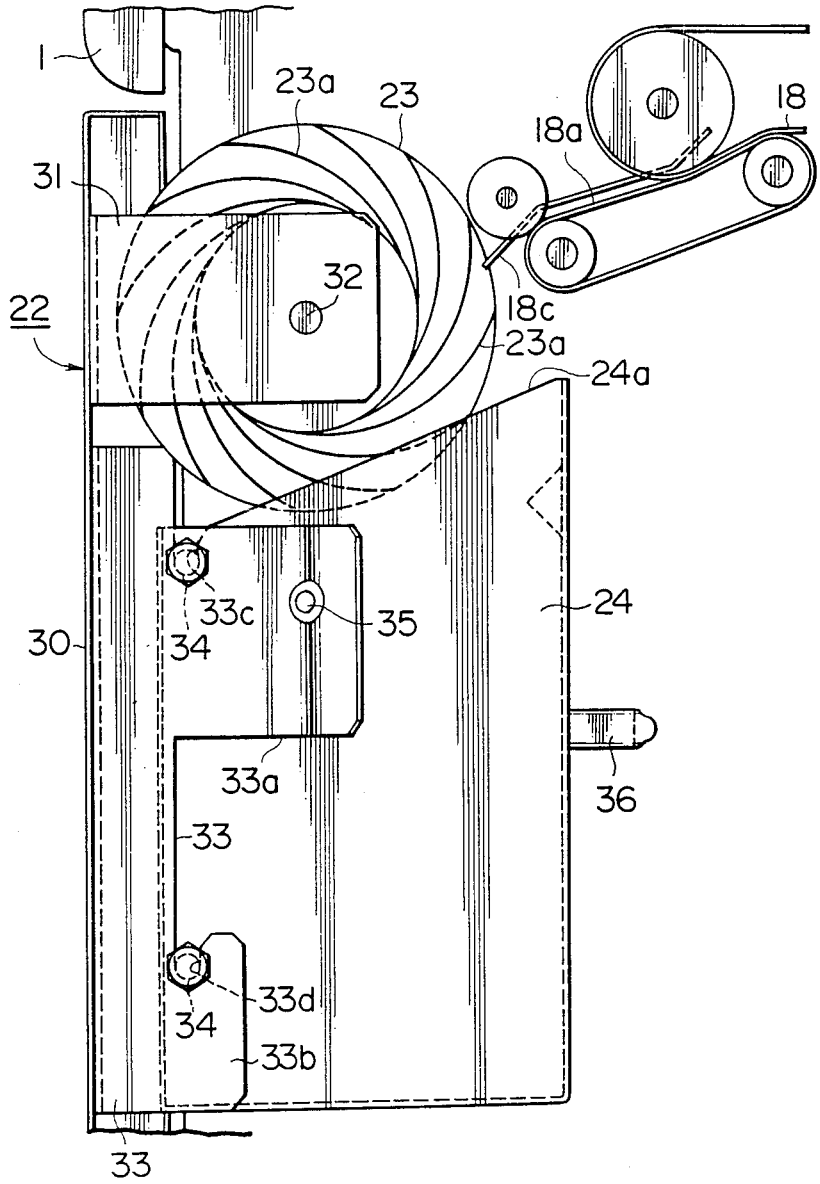
FIG. 1 is a side elevational view of the received bill containing apparatus forming a part of the bill receiving and dispensing machine of the present invention.
Figure 2:
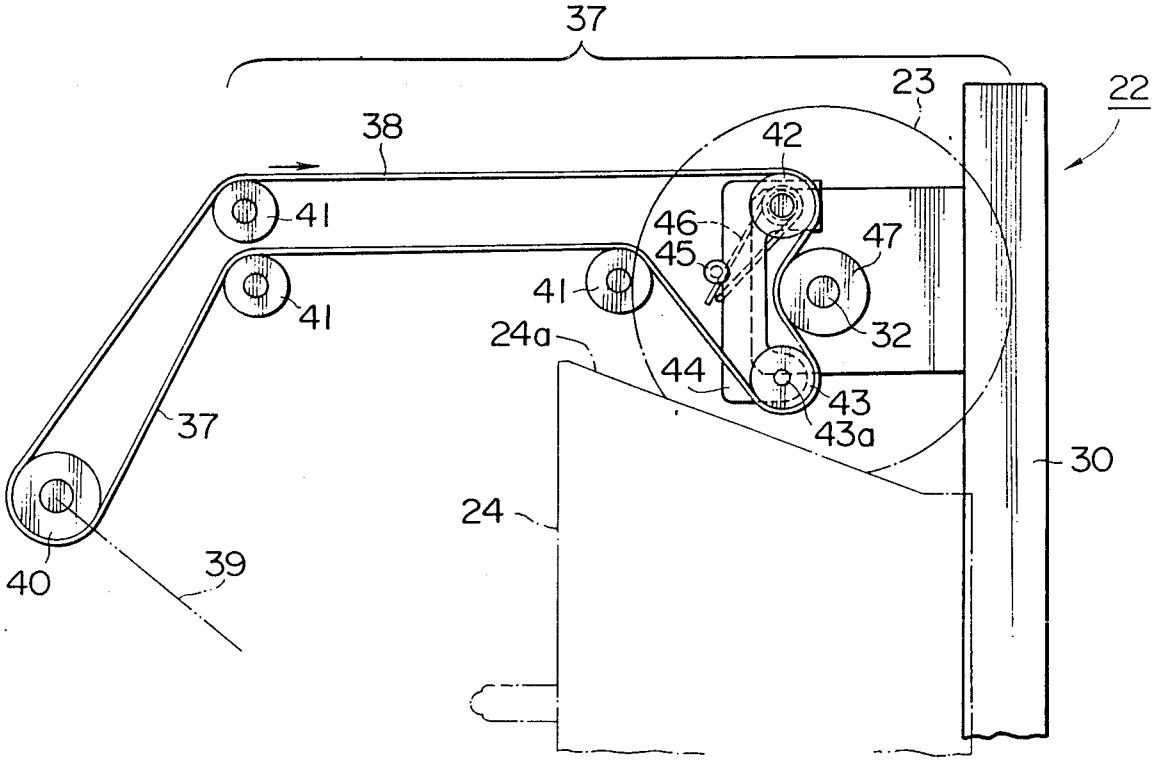
FIG. 2 is a side elevational view of the accumulating wheel driving mechanism forming a part of the bill receiving and dispensing machine of the present invention.

As shown in FIGS. 1 and 2, the received-bill containing apparatus 22 includes a front door 30 arranged at a front side of the machine body 1 for exposing the inside thereof, and the received-bill accumulation wheel 23 and the received-bill box 24 for receiving and holding the bills accumulated by the wheel 23, both the received-bill accumulating wheel 23 and the received-bill box 24 being mounted on the back of the front door 30. The received-bill accumulation wheel 23 is positioned slightly lower than the fore-end of the received-bill route 18 and is adapted to receive and accumulate the bills (in this preferred embodiment, "bills other than 10,000 yen bills" as mentioned earlier) which are separated by the third fork 19 positioned at the fore-end of the received-bill route 18 and fed out from a bill feeding-out belt 18*a*.

As shown in FIG. 1, the received-bill accumulation wheel 23 is rotatably mounted by a shaft 32 between a pair of brackets 31 secured to the back of the front door 30. When the wheel 23 is rotated clockwise, the bills fed out from the feeding-out belt 18*a* are inserted between a plurality of vanes 3*a* of the wheel 23 and then scraped away therefrom by a scraping member (not shown) and accumulated in the received-bill box 24.

The received-bill box 24 is detachably mounted on the back of the front door 30 by a pair of brackets 33 secured to the back of the front door 30 and pins 34 projected from the side walls of the received-bill box 24. Upper and lower portions 33*a* and 33*b* of the brackets 33 are formed with notches 33*c* and 33*d* respectively with which upper and lower sets of pins 34 can detachably engage. In FIG. 1, the numeral 24*a* denotes a top opening of the received-bill box 24, the numeral 35 denotes a sensor for detecting an upper limit of the bill amount, and the numeral 36 denotes a handle of the received-bill box 24.

FIG. 2 shows an accumulation wheel driving mechanism 37 for rotating the received-bill accumulation wheel 23 when the front door 30 is in a closed condition. The accumulation wheel driving mechanism 37 comprises a power transmitting train 39 including a power source such as a motor (not shown) secured to the machine body 1, a driving pulley 40 connected to the power transmitting train 39, a plurality of idle pulleys 41, 42 and 43 and a timing belt 38 traveling around these pulleys in the direction shown by an arrow. A pair of upper and lower pulleys 42 and 43 are supported on a pulley supporting member 44 which is pivotably mounted on a shaft 43*a* of the lower pulley 43. A spring 46 is disposed between a pin 45 secured to the machine body 1 and the pulley supporting member 44 (in this embodiment, a shaft of the upper pulley 42) to urge the pulley supporting member 44 in the clockwise direction around the shaft 43*a*. A roller 47 for driving the wheel 23 is secured to the shaft 32 of the wheel 23. The roller 47 is able to contact the belt 38 between the upper and lower pulleys 42 and 43 when the front door 30 to which the wheel 23 is mounted is closed. Thus, the driving force of the belt 38 can be transmitted to the roller 47 of the wheel 23 when the front door 30 is in a closed condition.

The circulating-bill accumulating wheel 20, the circulating-bill pooling section 21 and other components arranged adjacent to the wheel 20 and pooling section 21 will now be described with reference to FIG. 3.

The circulating-bill accumulating wheel 20 is positioned below the bill feeding-out belt 18*b* and is adapted to receive and accumulate the bills (in this embodiment, "10,000 yen bills") separated by the third fork 19 positioned at the fore-end of received-bill route 18. When the wheel 20 is rotated by a power source (now shown) in the counterclockwise direction of FIG. 3, the bills fed out from the bill feeding-out belt 18*b* are inserted between the vanes 20*a*, and rotated together with the wheel 20. During the rotation of the wheel 20, the bills held between the vanes 20*a* are scraped away therefrom by a scraping plate 48 (which also acts as a bill pressing-down plate) and accumulated on the circulating-bill pooling section 21.

The circulating-bill pooling section 21 is positioned inside the received-bill containing apparatus 22 in parallel therewith and comprises a bill supporting plate 49 descending toward the rear of the machine body 1, a front plate 50 positioned at the front of the machine body 1 and having an openable door (not shown), a positioning plate 51 for supporting and positioning the scraping plate, i.e. the bill pressing-down plate 48. A bill feeding-out port 21*a* is formed by the rear end of the bill supporting plate 49 and the bill pressing-down plate 48.

A sensor 52 is positioned above the bill supporting plate 49 so as to detect the amount of bills accumulated on the bill supporting plate 49 with their edges abutted against the bill pressing-down plate 48 or the positioning plate 51. When the sensor 52 detects that the bill amount has become less than a predetermined level, a lever 53 is rotated around a shaft 53*a* in the counterclockwise direction as shown by a phantom line in FIG. 3 so that the bill pressing-down plate 48 presses down the top of the bills on the bill supporting plate 49 to provide sufficient frictional force to a feeding-out roller positioned below the bill supporting plate 49 and adapted to contact the bottom of the accumulated bills. The bill pressing-down plate 48 is pivotably supported by a shaft 48*a*.

Figure 3:
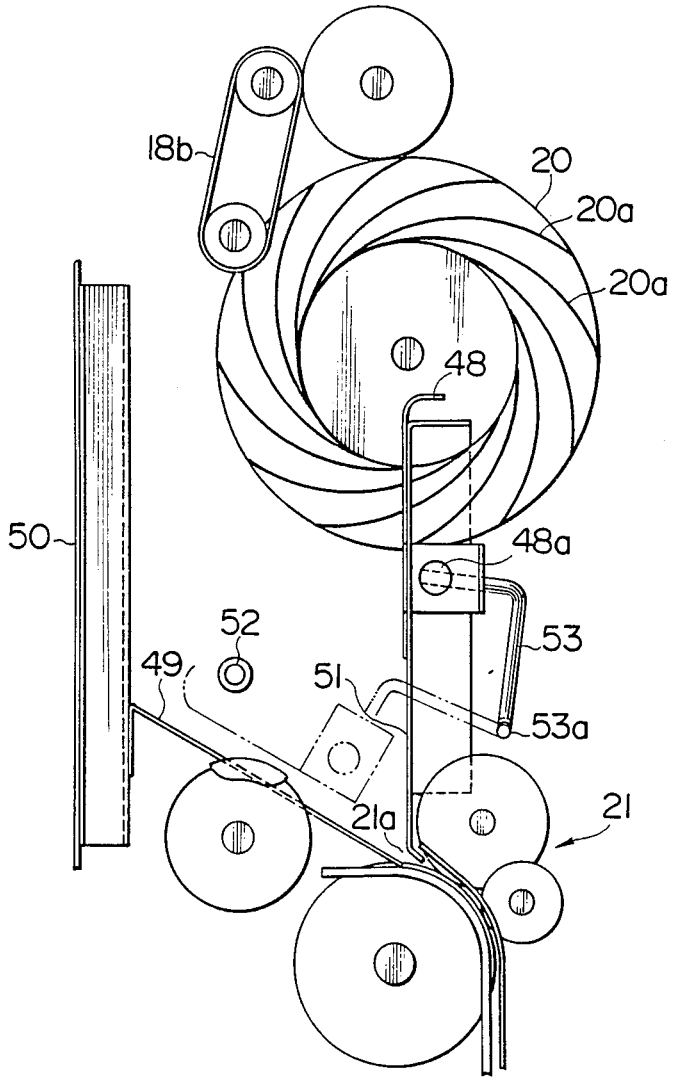
FIG. 3 is a side elevational view showing the vicinity of the circulating-bill pooling section forming a part of the bill receiving and dispensing machine of the present invention; and, FIG. 4 is a side elevational view showing the general construction of the bill receiving and dispensing machine of the present invention.

When the amount of the accumulated bills on the bill supporting plate 49 exceeds the predetermined level, since sufficient frictional force is provided to the feeding-out roller, the bill pressing-down plate 48 is kept in its retracted position as shown by a solid line in FIG. 3.

The other components will now be described. The transaction port 2 includes a bill supporting plate 4*a* descending from the shutter 3 and a vertical plate 4*b* forming the bill receiving and dispensing port 4. A feeding-out port 4*c* is formed between the plates 4*a* and 4*b*.

The discriminating route 6 is positioned behind the received-bill feeding-out mechanism 5 via a bill introduction portion 54 formed by bill transferring belts 55A, 55B for discriminating the genuineness and the type of the bills and for counting the number of bills transferred one by one by the belts 55A, 55B as sandwiched therebetween.

The received-bill route 18 comprises the lower one of the transferring belts 55A, 55B forming the discriminating route 6 and another transferring belt 56 opposed to the lower belt 55A. The bills are held between these belts 55A and 56 and transferred in reverse to the discriminating route 6 and then fed out either to the circulating-bill pooling section 21 or to the received-bill containing apparatus 22 by selectively switching the third fork 19.

The "received-bill distributing operation", "bill recovering operation" and "additional bill charging operation" will now be described.

Received-Bill Distributing Operation

As previously mentioned, when a bill receiving command is made by the user and the bills are actually dropped into the transaction port 2, the received bills are transferred to the discriminating route 6 and discrimination is made while they pass therethrough.

The bills discriminated as "genuine" are transferred from the bill delivering apparatus 13 to the accumulating and transferring mechanism 15 and then accumulated on the bill supporting plate 16. When a command allowing bill reception with respect to these accumulated bills is followed, the bills on the bill supporting plate 16 are dropped again into the bill receiving and dispensing port 4 and then transferred again to the discriminating route 6. In the discriminating route 6, bills other than 10,000 yen bills are discriminated and guided to the received-bill containing apparatus 22 by the third fork 19.

That is, as shown in FIG. 1, the genuine or normal bills other than 10,000 yen bills are fed out between the vanes 23*a* of the received-bill accumulation wheel 23 via the bill feeding-out belt 18*a* and the guide 18*c*. When the front door 30 is closed, the wheel 23 is rotated by the timing belt 38 and the bills held between the vanes 23*a* are scraped away therefrom by the scraping member (not shown) and dropped and held in the received-bill box 24.

As previously mentioned, 10,000 yen bills are held in the circulating-bill pooling section 21 for reuse as bills for dispensation.

Recovering Operation

When the sensor 35 detects that the amount of the bills other than 10,000 yen bills contained in the received-bill containing apparatus 22 exceeds the upper limit, the front door 30 is opened to take out the received-bill box 24 from the machine body 1. The received-bill box 24 can be separated from the front door 30 by releasing the engagement of pins 34 from the notches 33*c*, 33*d* of the bracket 33. Thus, the box 24 can be carried to a place suitable for bill recovering work.

It is possible to carry out the bill recovering operation for 10,000 yen bills contained in the circulating-bill pooling section 21 and 1,000 yen bills contained in the received-bill containing apparatus 27 by utilizing the bill recovering function of the bill receiving and dispensing machine itself. In case of 10,000 yen bills, the bill recovering operation is carried out by feeding out the bills in the circulating-bill pooling section 21 to the bill dispensing route 26 via the circulating-bill feeding-out apparatus 25 and then introducing the bills to the received-bill route 18 via the fourth fork 29 and feeding out the bills to the received-bill accumulation wheel 23 by the third fork 19 and finally holding them in the received-bill box 24. Thus, the 10,000 yen bills are recovered in the box 24.

Similarly, the 1,000 yen bills can be recovered in the received-bill box 24 by introducing them to the bill dispensing route 26 via the dispensation bill feeding-out apparatus 28. The 1,000 yen bills can be also recovered by opening the front door 30 and separating the dispensation bill box 27 from the machine body 1.

Additional Bill Charging Operation

In case of preparing 10,000 yen bills as dispensation bills, it is possible to charge them from the transaction port 2 to the circulating-bill pooling section 21 in a way similar to the received-bill distributing operation. It is also possible to directly charge the 10,000 yen bills in the circulating-bill pooling section 21 by opening the front door 30 to expose the front side of the circulating-bill pooling section 21 and then by opening the door (not shown) of the front plate 50. In case of preparing 1,000 yen bills, it is possible to simply charge them in the dispensation bill containing apparatus by opening the front door 30.

Since the inside of the machine body 1 is easily exposed by opening the front door 30, inspection and maintenance can also be carried out from the front of the machine body 1.

The preferred embodiment described above may be modified as following.

(i) The type of bill pooled in the circulating-bill pooling section may be properly selected.

(ii) The number of the circulating-bill pooling sections may be increased.

The bill receiving and dispensing machine of the present invention has the following effects.

(1) Since the received-bill box is mounted on the back of the front door, it is possible to easily expose the received-bill containing apparatus as well as the inside of the machine body merely by opening the front door. Accordingly, bill handling the maintenance work can be easily carried out from the front side of the machine body.

(2) Since the front space of the circulating-bill pooling section is exposed merely by opening the front door, it is possible to easily charge the additional bills and to carry out other bill inspecting work.

(3) Since the received-bill accumulation wheel mounted on (3) the front door is positioned at the fore-end of the received-bill transferring route when the front door is closed, it is possible to directly drop the accumulated bills into the received-bill containing box which is also mounted on the front door. This makes it possible to reduce the overall size of the bill receiving and dispensing machine.

What we claim is:

1. A bill receiving and dispensing machine comprising:

a bill receiving portion for receiving bills into the bill receiving and dispensing machine, a bill dispensing portion for dispensing bills from the bill receiving and dispensing machine, bill discriminating means for discriminating whether bills conveyed from said bill receiving portion via a bill discriminating route are genuine and also discriminating whether the denomination of each bill discriminated as genuine coincides with a predetermined denomination, bill pooling means for receiving bills discriminated as genuine and as having their denominations coincide with said predetermined denomination by said bill discriminating means and fed out from said bill discriminating means via a received bill route and holding them therein, a front door for exposing the inside of the bill receiving and dispensing machine to inspect said bill pooling means when said front door is open, an accumulation wheel having a plurality of vanes, said accumulation wheel being mounted on a back of said front door and positioned at an end of said received bill route for rotating bills discriminated as genuine and as having a denomination other than said predetermined denomination by said discriminating means and fed out from said bill discriminating means via said received bill route by holding the bills one by one between the vanes, a bill receiving box for receiving bills from said accumulation wheel and for holding the bills therein, said bill receiving box being mounted on the back of said front door, said bill pooling means being arranged behind said bill receiving box, at least one dispensation bill box, each for holding bills therein, the denominations of which are different from each other and said predetermined denomination, said at least one dispensation bill box being arranged below said bill receiving box and being accessible when said front door is open, and bill dispensing means for taking out bills from said bill pooling means and said at least one dispensation bill box and feeding the bills to said bill dispensing portion.

* * * * *